United States Patent [19]

Crookston et al.

[11] 4,131,774

[45] Dec. 26, 1978

[54] CIRCUIT INTERRUPTER OPERATING MECHANISM

[75] Inventors: Ronald W. Crookston, Trafford; Thomas N. Meyer, Murrysville, both of Pa.

[73] Assignee: Westinghouse Electric Corp., Pittsburgh, Pa.

[21] Appl. No.: 831,722

[22] Filed: Sep. 9, 1977

[51] Int. Cl.[2] ..... H01H 35/38

[52] U.S. Cl. ..... 200/82 B; 200/144 B; 200/337

[58] Field of Search ..... 200/82 R, 82 B, 337, 200/148 F, 148 B

[56] References Cited

U.S. PATENT DOCUMENTS

| | | | |
|---|---|---|---|
| 2,859,309 | 11/1958 | Schwager | 200/144 B |
| 3,303,309 | 2/1967 | Flurscheim | 200/144 B |
| 3,334,202 | 8/1967 | Tognella | 200/82 B |

*Primary Examiner*—Gerald P. Tolin
*Attorney, Agent, or Firm*—L. P. Johns

[57] ABSTRACT

A circuit interrupter characterized by a pair of separable contacts, operating means for opening and closing the contacts and operatively connected to the contacts, drive means for driving the operating means and comprising a cylinder and piston, the piston having a piston rod extending from the cylinder on the side opposite the operating means, generating means for generating a sudden expulsion of gaseous medium into the cylinder and against the piston, and a connecting link comprising a yoke extending around the cylinder and connected on one side to the piston rod and on the other side to the drive means.

1 Claim, 4 Drawing Figures

CIRCUIT INTERRUPTER OPERATING MECHANISM

CROSS-REFERENCE TO RELATED APPLICATIONS

This application is related to the applications Serial No. 762,542, filed January 26, 1977, and Serial No. 762,543, filed January 26, 1977.

BACKGROUND OF THE INVENTION

Field of the Invention

This invention relates to a circuit interrupter operating mechanism, and more particularly, it pertains to means for significantly reducing the operating time for circuit breakers by minimizing the dwell time.

Description of the Prior Art

Most circuit interrupters of prior construction have involved relatively long contact-opening time periods. Opening times have been continually reduced and typical means for expediting the opening and/or closing of contacts in circuit breakers are disclosed in U.S. Pat. Nos. 2,096,619, 2,436,194, 2,476,024, and 2,552,358.

Since circuit breakers of this type involve the use of various mechanical linkage mechanisms, it is necessary to initiate movement of the mechanism as soon as possible when an overcurrent occurs. Most mechanical devices for initiating the opening of contacts have suffered from a large initial dwell time, that is, the time loss in applying forces once a signal to open occurs. More recent innovations using electric fuse wire primers, although usually faster, still involve an ignition time which is slower than desirable or necessary.

More particularly, attention has been recently directed to the provision of more efficient drive means including the cylinder and piston assembly of prior construction which comprised a relatively large diameter and operated at lower pressures, such as about 5,000 psi or below. The replacement of those larger assemblies with cylinders of a smaller diameter and higher pressures, which could be as high as 50,000 psi or more, have met with some success. A disadvantage, however, of such innovations has been a continued problem of sealing certain movable parts as in prior constructions.

SUMMARY OF THE INVENTION

In accordance with this invention, it has been found that the foregoing problems may be overcome by providing a circuit interrupter comprising stationary and movable contacts, operating means for opening and closing the contacts and operatively connected to the movable contacts, drive means for driving the operating means and comprising a cylinder and piston assembly, the piston having a piston rod extending from the cylinder on a side opposite the operating means, generating means for generating a sudden expulsion of gaseous medium against the piston, and connecting means extending around the cylinder and comprising a yoke and connected on one side to the piston rod and on the other side to the drive means.

The advantage of the device of this invention is simplicity, compactness, and improved performance, including a two-cycle interrupting time when used for opening and lower cost for the oil-type circuit breaker and ability to revamp pneumatic units previously put in service for closing with a minimal expenditure and modification.

DESCRIPTION OF THE PREFERRED EMBODIMENT

Figure 1:
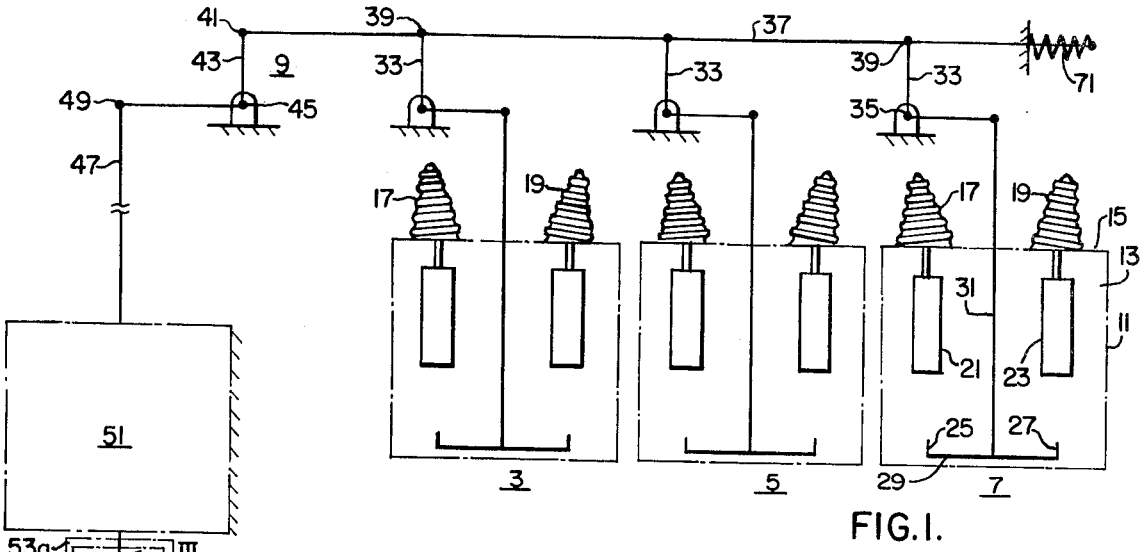
FIG. 1 is a diagrammatic elevational view, partly in section, showing a three-phase oil power circuit breaker and drive means for closing the breaker shown in intermediate position.

In the drawing, a drive mechanism is generally indicated at 1 and is operatively connected to a plurality of circuit interrupters 3, 5, 7, of conventional type, such as oil-break, air-break, or gas-blast type. Operating means, generally indicated at 9, extend between the drive mechanism 1 and the circuit breakers 3, 5, 7, each of which is similar to that shown in the sectional view of the breaker 7 and is typical of such breakers, as shown more particularly in Patent No. 2,477,788. It comprises a tank 11 containing a suitable arc-extinguishing fluid 13, a cover 15, and two terminal bushings 17, 19. Spaced stationary contact means 21, 23 are provided at the lower end of the terminal bushings 17, 19 which operate in conjunction with movable contacts 25, 27 mounted on a bridging contact member 29 at the lower end of an operating rod 31.

The upper end of each operating rod 31 is pivotally secured to lever means, such as, for example, a bell crank 33, which is stationarily pivoted at 35. A link 37 is pivoted at 39 to each bell crank 33 and at its other end is pivoted at 41 to a bell crank 43, which in turn is stationarily mounted at 45. A link 47, pivoted at 49 to the other end of the bell crank 43, is a vertical pull rod and is interconnected to a trip mechanism 51 that is connected to a connecting link or yoke 53. The operating mechanism 9 comprises the several parts 31, 33, 37, 43, 47, and 51.

In accordance with this invention, the drive mechanism 1 comprises a cylinder and piston assembly including a cylinder 55, a piston 57 having a piston rod 59, the lower end of which is secured such as at 61 to the lower end of the yoke 53. Generator means 63 for generating a sudden expulsion of gaseous medium against the piston 57 are provided in conjunction with the cylinder and piston assembly for opening the contacts within the tank 7. The construction and operation of the generator means is set forth more particularly in the application Ser. No. 762,542, filed Jan. 26, 1977, which is incorporated as part hereof. Briefly, the generator means is a gas generator 63 of the shotgun type comprising a propellant charge of expulsive material which upon ignition by an electric spark provided by conductors 65, 67 ignite to propel a high pressure gaseous medium through a conduit 69 into the cylinder 55. An example of the propellant charge is a double-base smokeless gunpowder which may generate a gas pressure of from about 3,000 to at least 10,000 psi within the cylinder 55 for driving the piston 57 to the lowermost position to thereby close the contacts. Simultaneously, a spring 71 at the end of the link 37 may be compressed to enable opening of the contacts upon reversal of the piston 57. One method of reversing the piston is to provide a gas vent 73 at the lower end of the cylinder 55, whereupon the spring may open the contacts. For that purpose, the spring 71 has the function of opening the contacts. The assembly of the cylinder and piston mechanism, together with the generating means 63, is fixedly mounted in a suitable manner, such as by a frame including spaced similar channels 75.

Although the connecting link 53 is disclosed as being a yoke having a substantially oval configuration, it may instead by a C-shaped member or any other configuration extending around the assembly of the cylinder, piston structure and the associated generator means 63. Suffice it to say, the connecting link 53 is a rigid member whereby motion of the piston 57 from the broken line position **57*a* moves the link 53 from the broken line position 53*a* to the lowermost position. The lower end of the link 53 is connected to the piston rod 59 at a side opposite the cylinder-piston assembly where the other end of the link 53 is connected through the tripping mechanism to the link 47 for actuating the operating mechanism 9** as set forth above.

The tripping mechanism 51 is similar in construction and operation to that disclosed in U.S. Serial No. 721,627, filed June 17, 1976 entitled "Circuit Breaker With Fast Trip Mechanism" of which the inventor is R. W. Crookston and is incorporated by reference herein. Because of the full disclosure in that patent, the description of the operating mechanism is limited herein to the basic structure and operation.

The link 47 is operatively connected to the yoke 53 by a suitable linkage. Toggle links 77, 79 comprise a pair of spaced parallel links pivotally connected by a pivot pin 81 to a coupling 83. The toggle link 79 is a single link between the links 77 and is pivotally connected by a pivot pin 85 to a coupling 87. The toggle links 77, 79 are pivotally connected together by a knee pivot pin 89.

Figure 2:
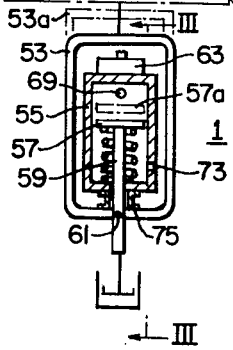
FIG. 2 is a diagrammatic elevational view, partly in section, showing a three-phase oil power circuit breaker and drive means for opening the breaker shown in intermediate position.
Figure 2:
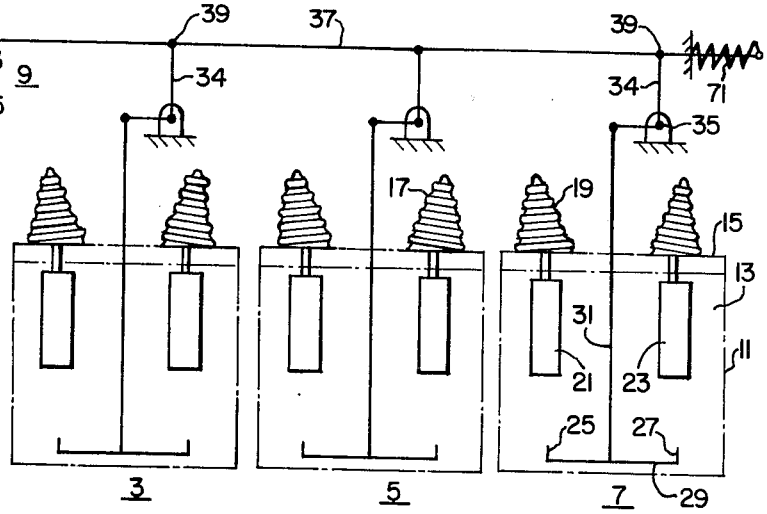
Figure 3:
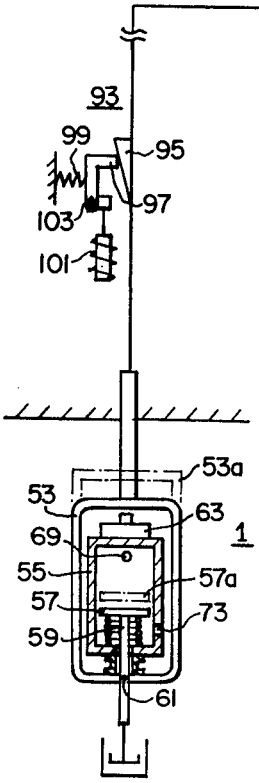
FIG. 3 is a sectional view, taken on the line III—III of FIG. 1.
Figure 3:
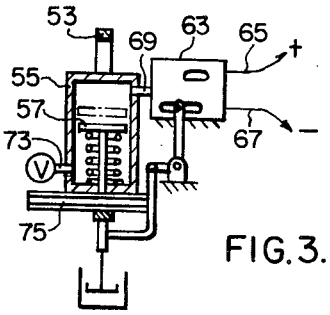
Figure 4:
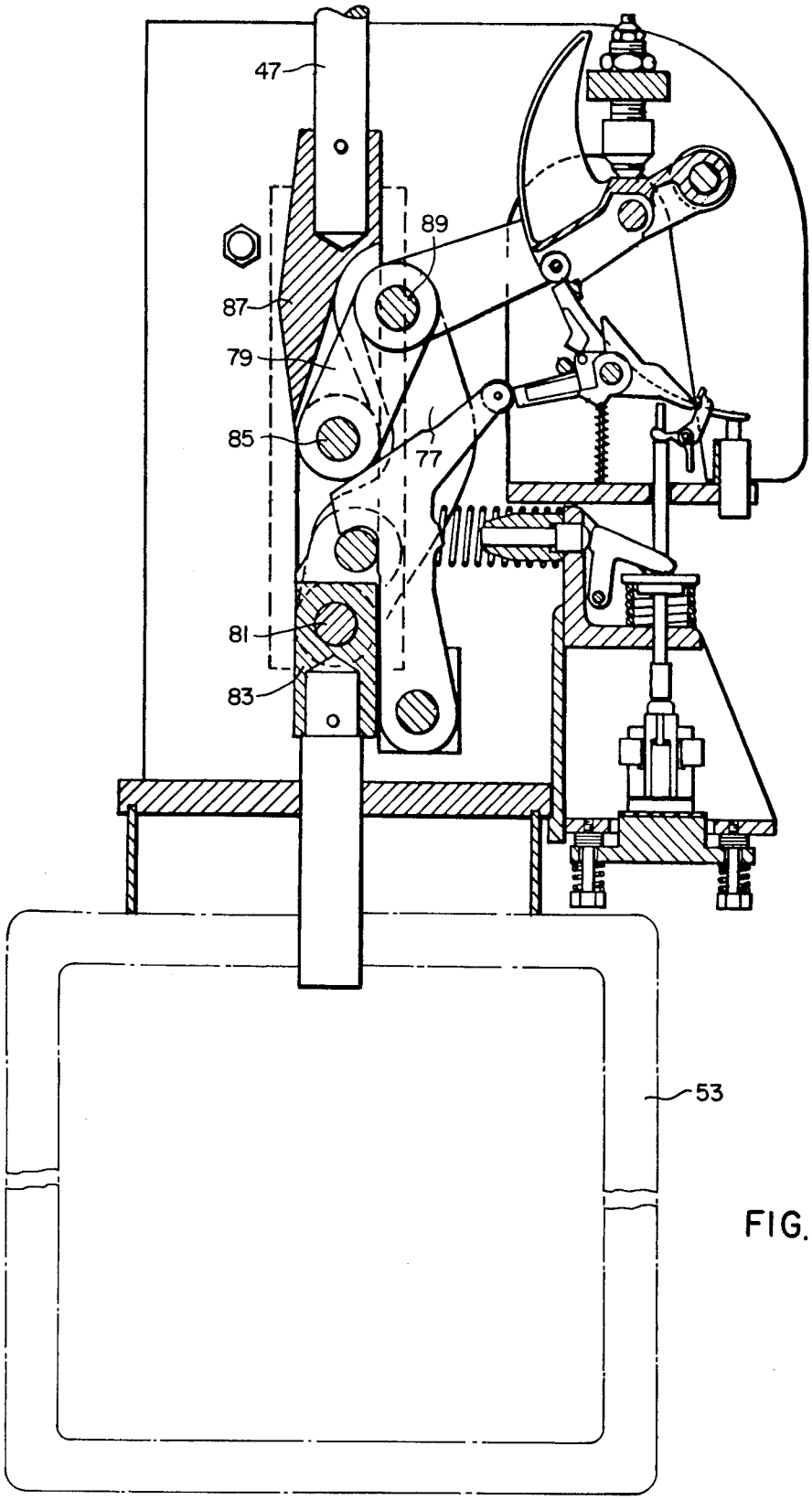
FIG. 4 is a vertical sectional view of an operating mechanism with modifications to accommodate the yoke.

Another embodiment of the invention is that shown in FIG. 2 in which similar numbers refer to similar parts. The mechanism shown in FIG. 2 operates to open the circuit interrupters 3, 5, 7 and differs primarily in that lever assemblies above each circuit interrupter include a bell crank lever 34 extending to the left instead of to the right, as shown for the bell cranks 33 in FIG. 1. In addition, a link 48 is provided with a latch mechanism generally indicated at 93 for holding the circuit interrupters in the open position. The mechanism 93 comprises a catch 95, a hook 97, a spring 99, and a solenoid 101. When the link 48 is lowered by the piston 57 to open the circuit interrupters 3, 5 and 7, the catch 95 on the link 48 is latched in place by the hook 93 which is pivoted at 103 and urged counterclockwise by the spring 99. The solenoid 101 releases the hook 97 from the catch 95 when the circuit interrupters are to be reclosed.

In conclusion, the drive mechanism for the electric circuit interrupter of this invention satisfies prior existing problems associated with the necessity of providing seals or gasket means previously associated with the outer end of the piston rod 59 which was otherwise directly connected to an operating mechanism through a member such as the bell crank 43, whereby a simpler, more compact, and improved performance is obtained.

What is claimed is:

1. An electric circuit interrupter comprising a pair of separable contacts, operating means for opening and closing the contacts and comprising a longitudinally movable link operatively connected to the contacts, drive mechanism for driving the operating means and comprising a cylinder and piston, the piston having a piston rod extending from the cylinder on a side opposite the operating means, generator means for generating a sudden expulsion of gaseous medium into the cylinder and against the piston, the piston being actuable by the gaseous medium to drive the operating means between open and closed positions of the contacts, the piston rod being substancially in movable planar alignment with the movable link and being movable longitudinally from the end of the cylinder opposite said movable link, a connecting link directly connected at one end to the piston rod and indirectly connected to the movable link at the other end, and the connecting link extending around the cylinder.

* * * * *